US006644876B2

(12) United States Patent
Carriere et al.

(10) Patent No.: US 6,644,876 B2
(45) Date of Patent: Nov. 11, 2003

(54) METHOD AND APPARATUS FOR PRINTER CARTRIDGE IDENTIFICATION

(75) Inventors: Richard L. Carriere, Oak Creek, WI (US); Peter G. Ross, West Allis, WI (US); Kevin L. Wilken, De Pere, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 09/999,114

(22) Filed: Nov. 1, 2001

(65) Prior Publication Data

US 2003/0081978 A1 May 1, 2003

(51) Int. Cl.[7] ..... B41J 3/39; B41J 29/00; B41J 2/175; B41F 1/08

(52) U.S. Cl. ..... 400/691; 400/679; 400/611; 400/613; 400/207; 400/175; 400/61; 400/70; 400/76; 101/196; 347/86

(58) Field of Search ..... 400/679, 691, 400/611, 613, 83, 615.2, 621, 61, 70, 76, 207, 237, 249, 174, 175, 208, 692, 703, 704; 101/196, 287, 288; 347/84, 85, 86, 87

(56) References Cited

U.S. PATENT DOCUMENTS 4,080,625 A * 3/1978 Kawamoto et al. ..... 369/126
4,264,396 A 4/1981 Stewart
4,407,692 A 10/1983 Torbeck
4,440,248 A 4/1984 Teraoka
4,473,426 A 9/1984 Goodwin et al.
4,477,305 A 10/1984 Hamisch et al.
4,490,206 A 12/1984 Makley
4,497,682 A 2/1985 Hamisch, Jr.
4,498,947 A 2/1985 Hamisch, Jr. et al.
4,501,224 A 2/1985 Shibayama et al.
4,511,422 A 4/1985 Hamisch, Jr. et al.
4,544,434 A 10/1985 Mistyurik
4,556,442 A 12/1985 Torbeck
4,630,538 A 12/1986 Cushman
4,655,129 A 4/1987 Wirth et al.
4,680,078 A 7/1987 Vanderpool et al.
4,815,875 A 3/1989 Richardson et al.
5,078,523 A 1/1992 McGourty et al.
5,411,339 A 5/1995 Bahrabadi et al.
5,492,420 A 2/1996 Nunokawa et al.
5,533,818 A 7/1996 Bahrabadi
5,562,353 A 10/1996 Handa et al.
5,788,387 A 8/1998 Takayama et al.
5,885,016 A 3/1999 Toyosawa et al.
6,000,773 A 12/1999 Murray et al.
6,040,849 A 3/2000 McIntyre et al.
6,149,256 A * 11/2000 McIntyre et al. ..... 347/2
6,161,915 A 12/2000 Bolash et al.
6,195,668 B1 2/2001 Toyosawa et al.
6,491,454 B1 * 12/2002 Toyosawa et al. ..... 400/83
2002/0154480 A1 * 10/2002 Wakabayashi et al. ..... 361/687

OTHER PUBLICATIONS

US 4,561,048, 12/1985, Takamura et al. (withdrawn)

* cited by examiner

*Primary Examiner*—Andrew H. Hirshfeld
*Assistant Examiner*—Hoai-An D. Nguyen
(74) *Attorney, Agent, or Firm*—Quarles & Brady LLP

(57) ABSTRACT

A cartridge identification system for identifying a characteristic of a cartridge inserted in a printer. The cartridge identification system comprises an identification circuit which is triggered by an electrical connection between a printed circuit board coupled to the cartridge and a plurality of spring contacts in a cartridge receptacle in the printer. An electrical logic signal is read by an internal processing unit, which determines a characteristic of the cartridge based on the logic signal.

10 Claims, 11 Drawing Sheets

FIG. 11
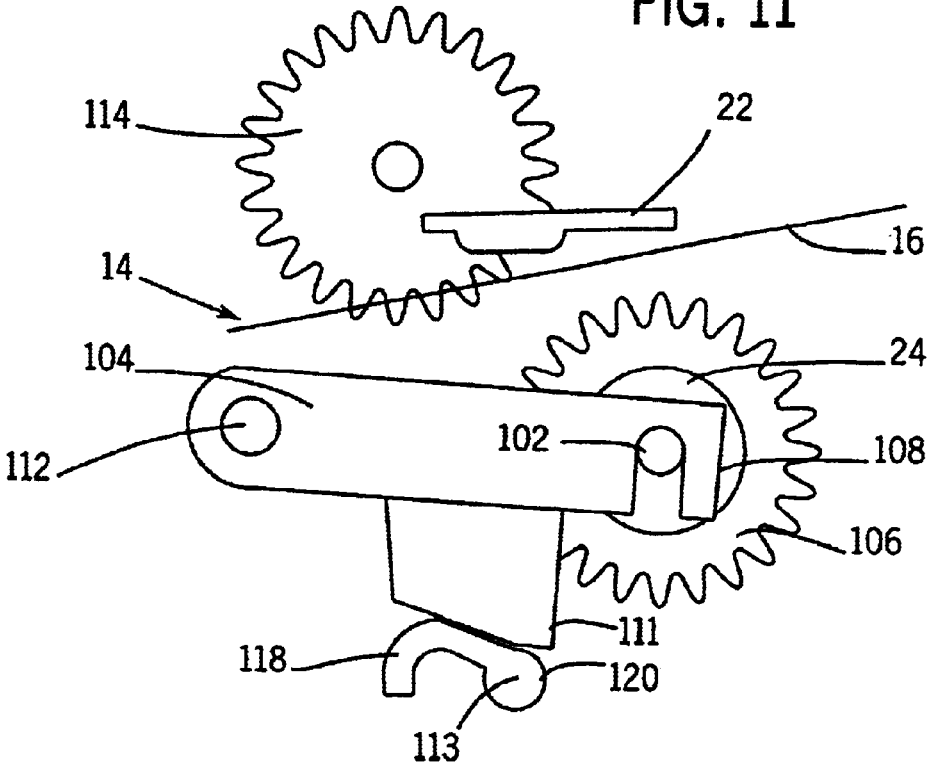
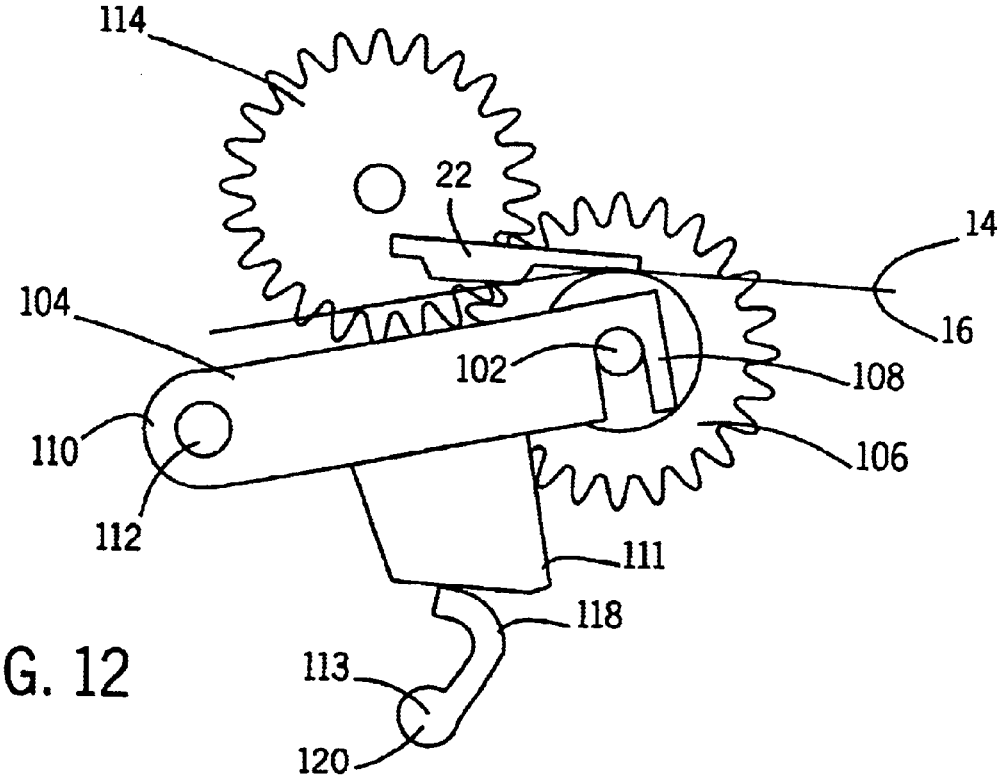
FIG. 12

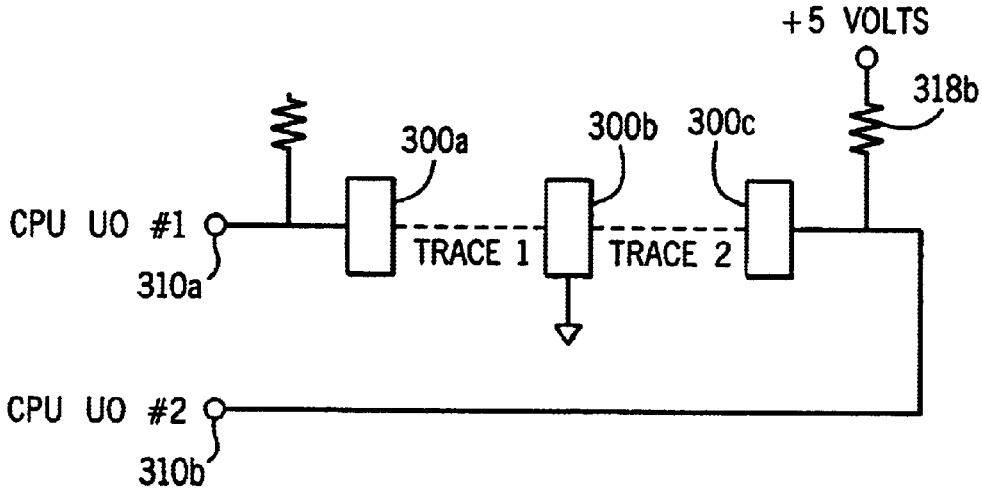
FIG. 17
FIG. 18
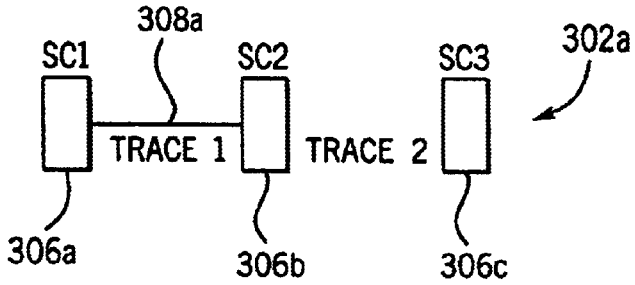
FIG. 19
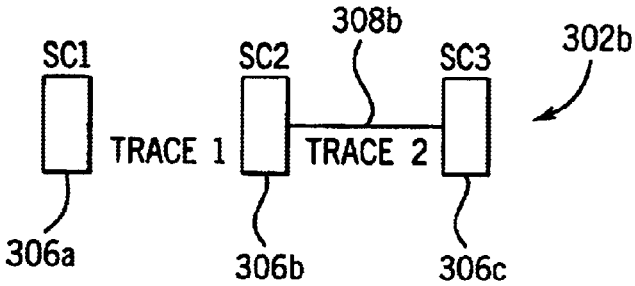
FIG. 20
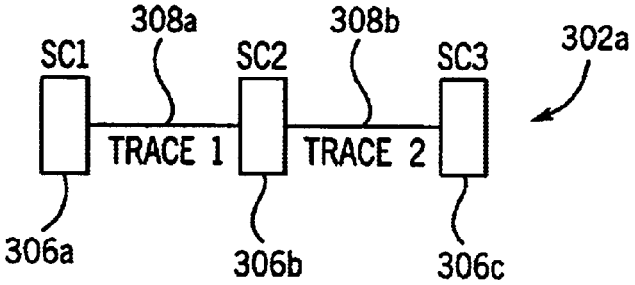

METHOD AND APPARATUS FOR PRINTER CARTRIDGE IDENTIFICATION

CROSS REFERENCES TO RELATED APPLICATIONS

Not Applicable

STATEMENT REGARDING FEDERALLY SPONSORED RESEARCH

Not Applicable

TECHNICAL FIELD

The present invention relates to a cartridge-based printer and associated cartridge, and more particularly to a method and apparatus for identifying a cartridge inserted in a cartridge-based printer.

DESCRIPTION OF THE BACKGROUND ART

There are a number of U.S. patents that disclose electronic apparatus for printing indicia on labels, some of these are restricted to hand held units and others that disclose tabletop units. Hand held labeling machines are disclosed, for example, in U.S. Pat. Nos. 4,264,396, Stewart; U.S. Pat. No. 4,407,692, Torbeck; U.S. Pat. No. 4,473,426, Goodwin et al.; U.S. Pat. No. 4,477,305, Hamisch; U.S. Pat. No. 4,490,206, Makely; U.S. Pat. No. 4,497,683, Hamisch; U.S. Pat. No. 4,498,947, Hamisch et al.; U.S. Pat. No. 4,511,422, Hamisch et al.; U.S. Pat. No. 4,544,434, Mistyurik; U.S. Pat. No. 4,556,442, Torbeck; U.S. Pat. No. 4,561,048, Hamisch et al.; and U.S. Pat. No. 4,680,078, Vanderpool et al. Tabletop units for this general purpose, some of which are portable are described in U.S. Pat. Nos. 4,440,248, Teraoka; U.S. Pat. No. 4,501,224, Shibayama; U.S. Pat. No. 4,630,538, Cushing; and U.S. Pat. No. 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a LED, LCD unit to assist the operator in using the machine. In a hand held printer, these components may all be enclosed in a single housing.

The labeling media comprises labeling material attached to a carrier strip, and is fed through the printer. Legends, or other indicia, are printed on the labels by the printer. The printed labels are then removed from the carrier strip and attached to the objects needing identification. As there are many types of label applications, there are many combinations of labels and carrier strips that provide labels of varying sizes, colors and formats.

A particular type of print head employs thermal transfer printing technology. Thermal transfer printing uses a heat generating print head to transfer a pigment, such as wax, carbon black, or the like, from a thermal transfer ribbon to a labeling media. By using digital technology, characters are formed by energizing a sequence of pixels on the print head which in turn melt the wax or other pigment on the ribbon transferring the image to the labeling media.

Many prior art thermal printers include various means and methods for automatically identifying a width or identifying a characteristic feature of a labeling media or tape associated with a cartridge inserted in a cartridge-based printer. For example, U.S. Pat. No. 5,492,420, Nunokawa, discloses a plurality of holes formed on the bottom of a cartridge wall wherein the depths of the holes are varied to selectively trip a plurality of switches in the cartridge holder, thereby providing an indication of the type of cartridge that has been inserted. Similarly, U.S. Pat. No. 5,553,818 discloses a portable printer in which a plurality of plunger assemblies in the printer mechanism are selectively activated depending on the configuration of a plurality of punch-out tabs in the cartridge to provide an indication of the type of cartridge inserted in a printer. Another similar system, U.S. Pat. No. 5,562,353 discloses a tape printing apparatus in which microswitches in the printer are selectively tripped by projections on the cartridge to provide identification information.

While a number of identification circuits for identifying a cartridge inserted in a cartridge-based label printer are therefore known in the art, these systems typically require complicated switching systems which require a number of moving parts, and are therefore relatively expensive to implement. Furthermore, due to the number of moving parts, repetitive insertion and removal of a cartridge from the printer can cause significant wear on the switching systems, which can lead to incorrect identifications, maintenance problems and even failure of the printer. A need exists, therefore, for a cartridge identification system for use in a hand held cartridge-based label printer which is inexpensive to construct, reliable, and easy to maintain.

SUMMARY OF THE INVENTION

The present invention provides a method and apparatus for identifying a cartridge inserted in a cartridge-based printer. Generally, a first plurality of electrical contacts are provided on the printer cartridge. As the printer cartridge is inserted into the printer, a second plurality of electrical contacts in the printer mate with the first plurality of contacts, providing an identification of the cartridge to internal printer circuitry. The identification provides information relating to characteristics of the inserted cartridge, and more particularly identifies a width of a labeling media contained in the cartridge More specifically, the cartridge-based printer includes a plurality of spring contacts which extend axially into a cartridge receptacle. The spring contacts are each electrically coupled to a printed circuit board in the thermal printer device, where they are selectively connected to a circuit common and/or a reference potential. The cartridge includes a printed circuit board or other conductive media supplying a second plurality of electrical contacts. When the cartridge is inserted in the cartridge receptacle, the electrical contacts coupled to the wall of the cartridge selectively connect one or more of the spring contacts in the cartridge receptacle to another of the spring contacts in the cartridge receptacle, providing an electrical identification signal identifying the cartridge, and more particularly a width of the labeling media in the cartridge.

The spring contacts are designed to elastically deform and to provide a spring force opposing the cartridge when the cartridge is inserted into the cartridge receptacle, and to expand when the cartridge is removed. The force provided by the elasticity of the spring contact therefore provides and maintains a strong electrical connection between the conductive material coupled to the cartridge and the printed circuit board in the printer. Furthermore, due to the ability to expand and contract, the spring contacts can provide an accurate identification of the inserted cartridge, even when there are minor variations in the size of the cartridge or in the alignment of the cartridge in the cartridge receptacle.

The second plurality of electrical contacts are preferably constructed as a printed circuit board. The printed circuit board can be constructed of typical circuit board materials, or can comprise a flexible printed circuit board, a metallized tape, or other conductive material. The printed circuit board is preferably adhesively coupled to the wall of the cartridge, thereby providing an inexpensive means for identifying the cartridge.

A general objective of the present invention is to provide a method and apparatus for automatically identifying a characteristic of a cartridge inserted in a cartridge-based printer which is inexpensive to implement. This objective is accomplished by providing an identification circuit which comprises an electrical connection between inexpensive electrical spring contacts and a printed circuit board.

Another object of the invention is to provide a method and apparatus for automatically identifying a characteristic of a cartridge inserted in a cartridge-based printer which has high durability. This objective is achieved by providing an electrical identification circuit with a minimal number of moving parts.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 11 is a detailed top view of the printer mechanism assembly of FIG. 3 with the platen roller in the nonprinting position;

FIG. 12 is a detailed top view of the printer mechanism assembly of FIG. 4 with the platen roller in the printing position;

FIG. 17 is a partial circuit diagram illustrating the connection of the spring contact;

FIG. 18 is a first embodiment of the printer circuit board of FIG. 5;

FIG. 19 is a second embodiment of the printed circuit board of FIG. 5; and FIG. 20 is a third embodiment of the printed circuit board of FIG. 5.

DETAILED DESCRIPTION OF THE PREFERRED EMBODIMENTS

Figure 1:
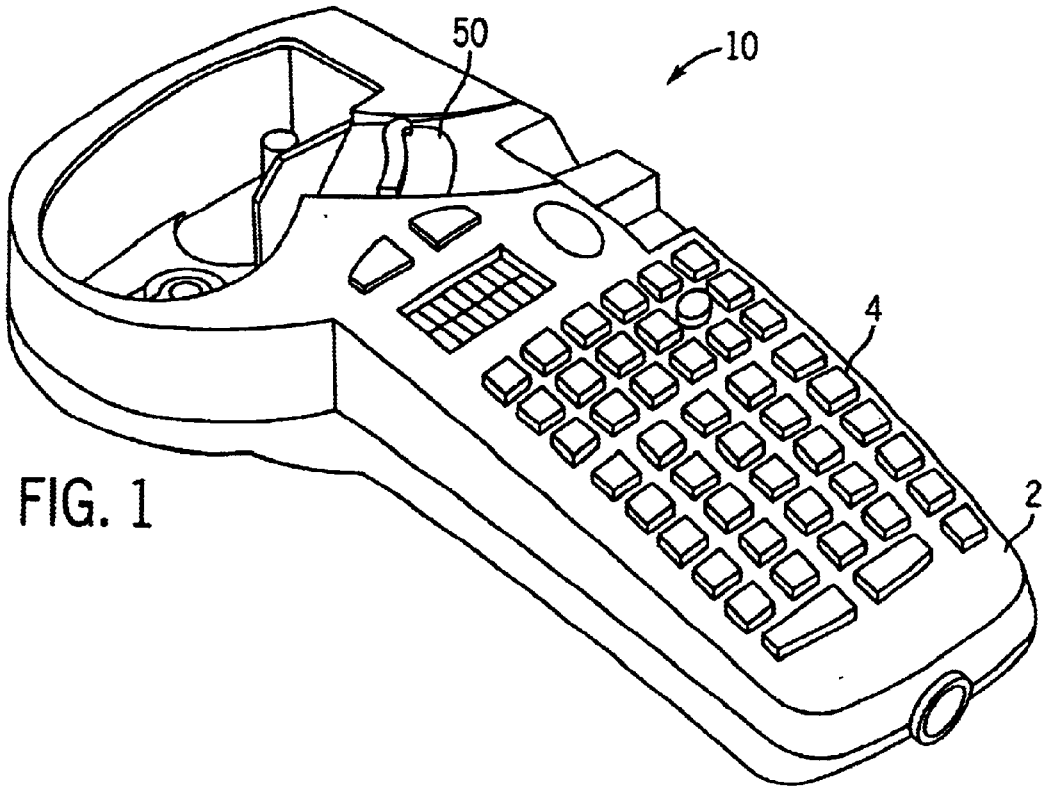
FIG. 1 is a perspective view of a hand held label printer which employs the present invention.
Figure 2:
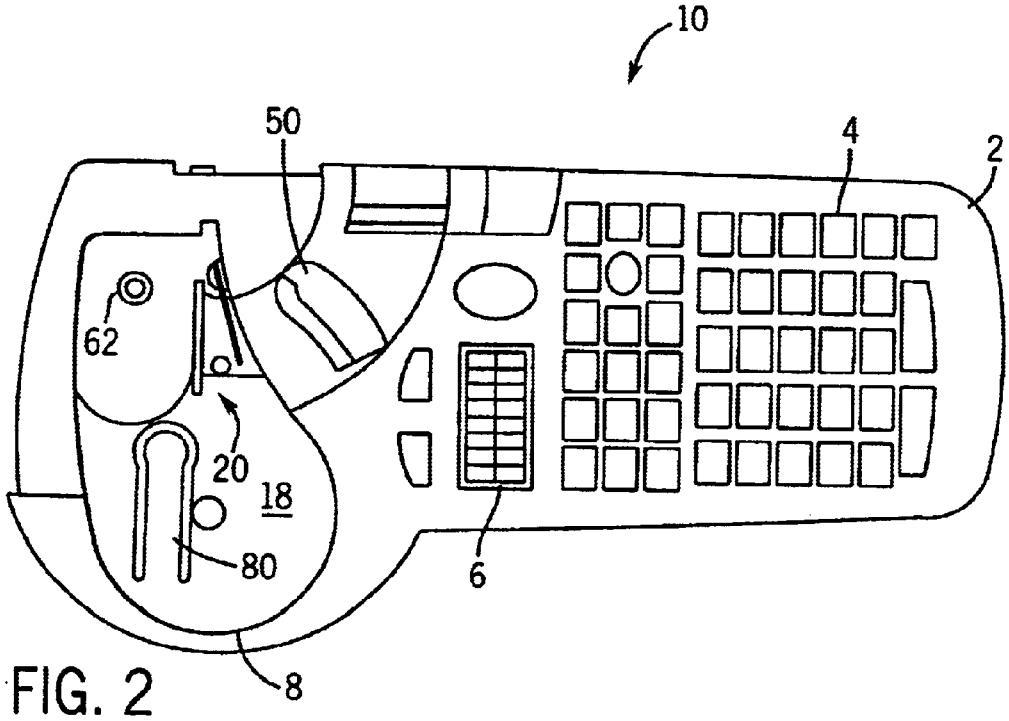
FIG. 2 is a top view of the printer of FIG. 1 with the cartridge removed.
Figure 3:
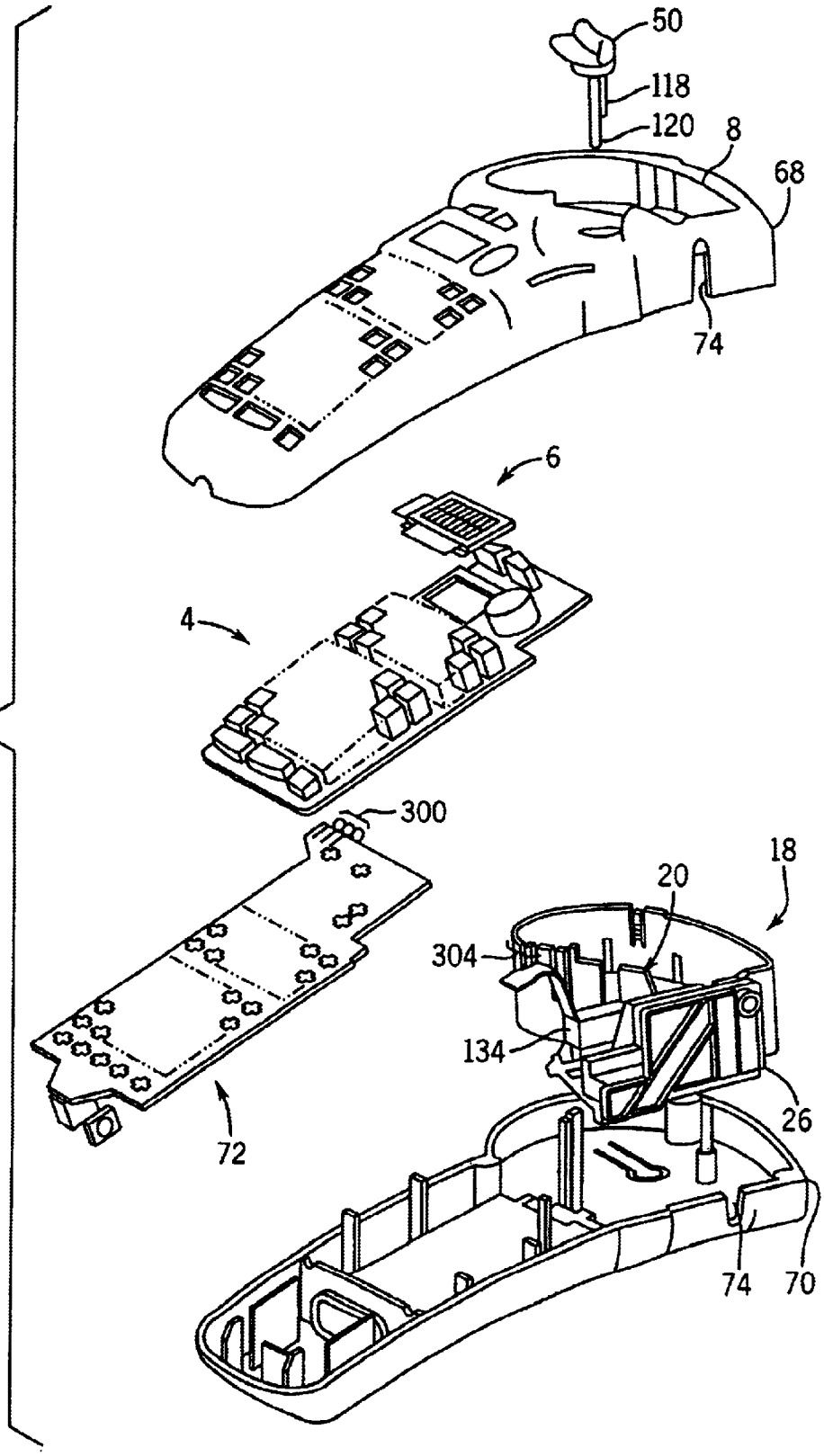
FIG. 3 is an exploded perspective view of the printer of FIG. 2.
Figure 4:
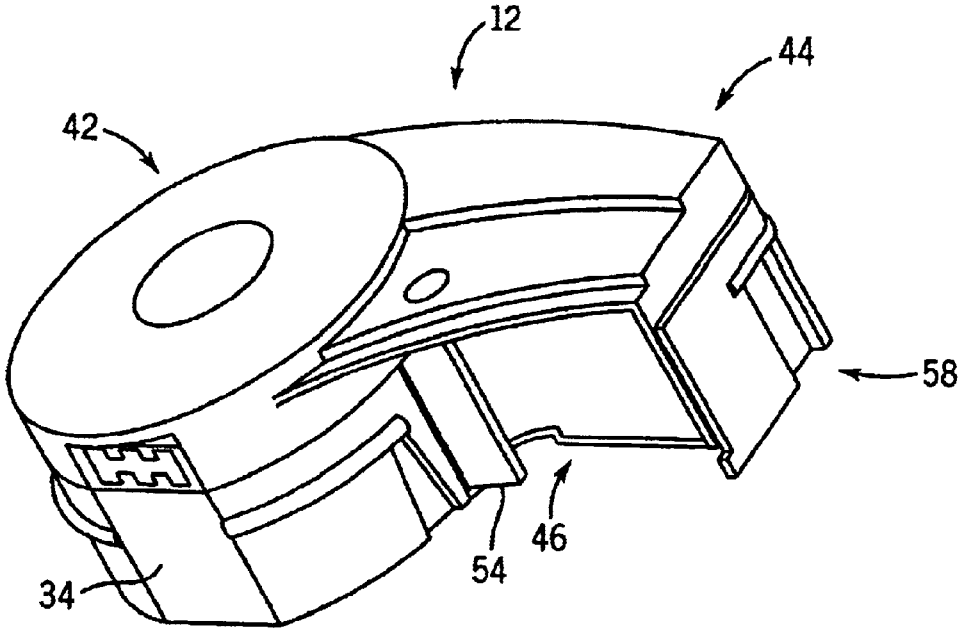
FIG. 4 is a top perspective view of the cartridge of FIG. 1.
Figure 6:
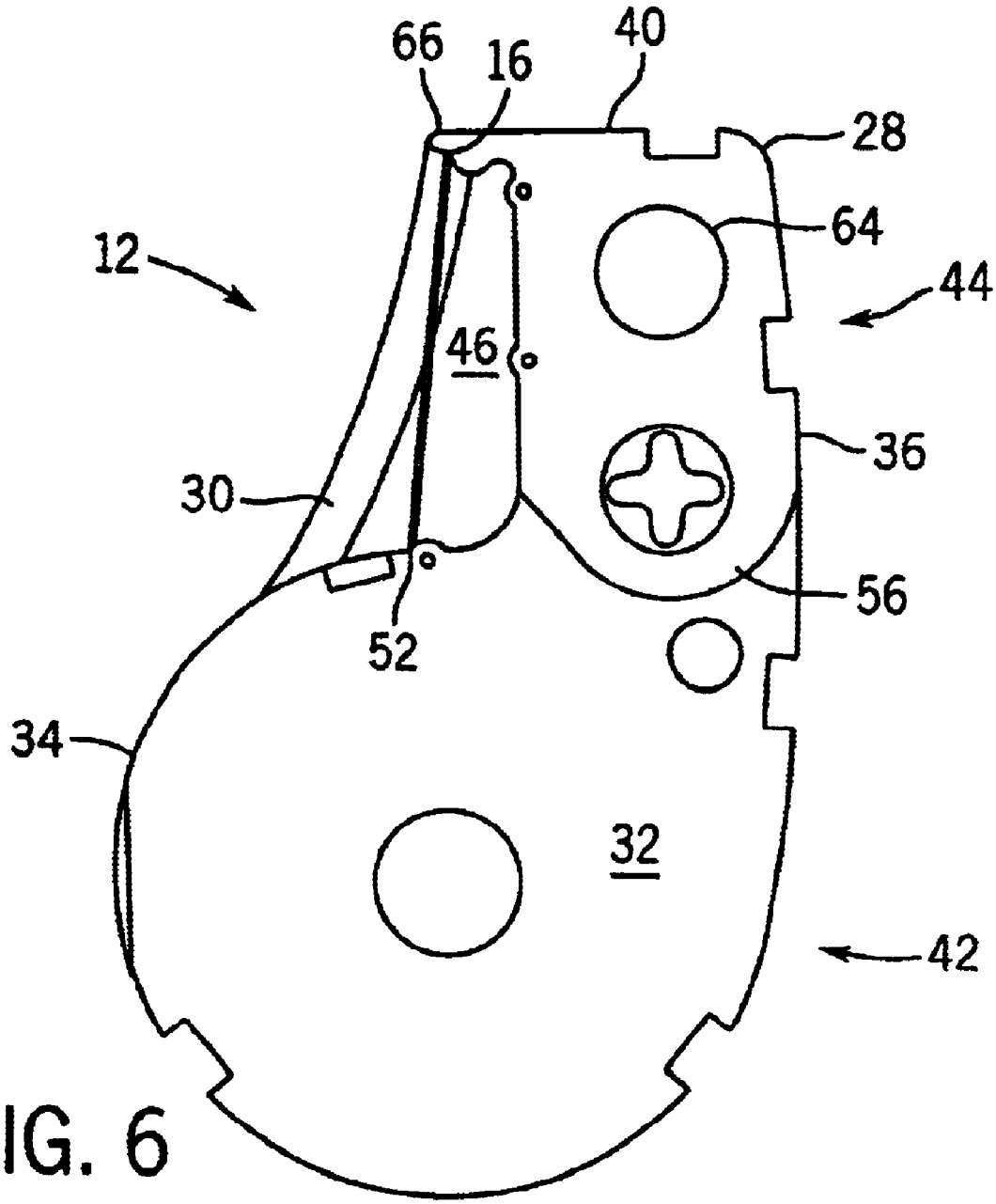
FIG. 6 is a bottom view of the cartridge of FIG. 1.

Referring particularly to FIGS. 1–3, a thermal printing machine 10 which employs the preferred embodiment of the present invention includes a molded plastic housing 2 that supports a keyboard 4 on its front surface and a display 6 positioned above the keyboard 4. An opening 8 formed in the housing 2 above the display 6 receives a cartridge 12 containing labeling media 14 and an ink ribbon 16 (shown in FIG. 6). The cartridge 12 is inserted through the opening 8 into a cartridge receptacle 18 housed in the printer housing 2, and the labeling media 14 and ink ribbon 16 from the cartridge are threaded through a printer mechanism assembly 20 including a print head 22 and roller platen 24 for printing indicia on labels forming part of the labeling media 14. The printed labels pass through a cutter mechanism 26 which cuts the labeling media to separate the printed labels from unprinted labels.

The labeling media 14 is known in the art, and generally comprises a carrier web which supports a series of adhesive labels. The size, width, color, and type of web material varies depending upon the particular print application. The labeling media is dispensed from the cartridge 12, and urged along a web path as it is consumed by the printer 10.

Referring to FIGS. 3–7, the cartridge 12 includes a cartridge housing 28 having a top wall 30 and a bottom wall 32 joined by periphery walls 34, 36, 38, 40. The periphery walls 34, 36, 38, 40 define a semi circular labeling media container 42 and a rectangular ink ribbon container 44 joined to the labeling media container 42. The top wall 30 extends past the periphery walls 34, 38, and defines a printing area 46 outside of the housing periphery walls 34, 38 at the junction of the labeling media container 42 and ink ribbon container 44. Labeling media 14 and ink ribbon 16 from inside the cartridge housing 28 pass through the printing area 46 for engagement with the roller platen 24 and print head 22. A shelf 48 formed along one edge of the top wall 30 is flush with the printer opening 8 to allow engagement of the shelf 48 with a lever 50 which locks the cartridge 12 in the receptacle 18.

The labeling media container 42 receives the labeling media 14 in the form of a roll. An exit slot 52 formed in the periphery wall 34 defining the labeling media container 42 opens into the printing area 46, and provides an exit for the labeling media 14 and ink ribbon 16 to pass out of the cartridge housing 28 and into the printing area 46. A projection 54 extending adjacent to the exit slot 52 guides the labeling media 14 and ink ribbon 16 as they exit the cartridge 12 through the exit slot 52.

The ink ribbon container 44 extends tangentially from the semicircular labeling media container 42, and has a proximal end 56 which opens into the labeling media container 42 and an opposing, closed, distal end 58 joined by the exterior periphery wall 36 which is a tangential extension of the labeling media container periphery wall 34. The interior ink ribbon periphery wall 38 extending between the proximal and distal ends 56, 58 is spaced from the ink ribbon exterior periphery wall 36, and defines a boundary of the printing area 46. Ink ribbon 16 which has passed through the printing area 46 reenters the ink ribbon container 44 through an entrance slot 60 formed at the junction of the interior ink ribbon periphery wall 38 and the ink ribbon container periphery end wall 40.

An ink ribbon supply spool (not shown) is supported between the top and bottom walls 30, 32 of the cartridge housing 28, and has a roll of ink ribbon 16 wound thereon. The ink ribbon 16 is unwound from the supply spool, and passes out of the cartridge 12 with the labeling media 14 through the exit slot 52. The ink ribbon 16 reenters the cartridge 12 through the entrance slot 60, and is wound onto an ink ribbon take up spool (not shown).

The take up spool is supported between the cartridge housing top and bottom walls 30, 32, and is rotatably driven by an ink ribbon drive shaft 62 which extends through an opening 64 formed in the cartridge bottom wall 32. The shaft 62 engages the take up spool to rotatably drive the spool and wind the ink ribbon 16 thereon.

A labeling media guide 66 is formed at the ink ribbon container distal end 58, and extends perpendicular to the interior ink ribbon periphery wall 38. A guiding slot 67 formed in the guide 66 directs the labeling media 14 which has passed through the printing area 46 toward the cutter mechanism 26.

A conductive strip 302 is coupled to the periphery wall 34. The conductive strip 302 is positioned on the wall 34 in a location selected to provide an electrical connection between the conductive strip 302 and spring contacts 300 (FIG. 3) for identifying the cartridge 12 as will be described below. The wall 34 can include a flat mounting section 303 to which the conductive strip 302 can be mounted by adhesive, or in other ways apparent to those of skill in the art. The conductive strip 302 is preferably adhesively coupled to the wall 34 of the cartridge 12, and can be constructed of typical circuit board materials, flexible printed circuit board materials, a metallized tape, or other conductive material.

Referring back to FIGS. 1–3, the cartridge 12 is received in the cartridge receptacle 18 housed in the printer housing 2. The printer housing 2 is, preferably, formed from two halves 68, 70, and houses printer components, such as the cartridge receptacle 18, the keyboard 4, display 6, the cutter mechanism 26, a printed circuit board 72 having printer circuitry, an identification circuit for identifying a cartridge 12 inserted into the cartridge receptacle 18, and the like. The printed circuit board 72 further includes a plurality of spring contacts 300 which extend from one end of the board 72 into the cartridge receptacle 18 of the assembled printer 10 for electrically connecting to the conductive strip 302 coupled to the cartridge 12, as described below.

The opening 8 formed in the housing top half 68 provides access to the cartridge receptacle 18 for insertion of the cartridge 12 into the receptacle 18. A slot 74 formed in the housing 2 adjacent the cutter mechanism 26 provides an exit for labeling media 14 (FIG. 6) which has passed through the cutter mechanism 26.

Referring to FIGS. 6–12, the cartridge receptacle 18 has a sidewall 76 generally shaped to conform with the cartridge periphery walls 34, 36, 38, 40, and a floor 78 which supports the cartridge 12 therein. The sidewall 76, therefore, includes at least a portion which is semi-circular or arcuate in shape to receive the semi-circular labeling media container 42. A plurality of slots 304 are defined in the sidewall 76, the slots 304 being sized and dimensioned to receive the spring contacts 300 (FIG. 3) extending axially from the printed circuit board 72 (FIG. 3).

An eject mechanism 80 is formed as an integral part of the receptacle floor 78, and includes a cantilevered arm 82 with a button 84 extending perpendicular to the arm 82 from the arm distal end 86. The button 84 extends away from the receptacle floor 78 through the printer housing 2 (FIG. 2) for engagement by a user. The user urges the button 84 toward the receptacle 18 to engage the arm 82 with the cartridge 12 and push the cartridge 12 out of the receptacle 18.

The printer mechanism assembly 20 is fixed to the printer receptacle 18, and includes the stationary print head 22 and pivotable platen roller 24 mounted on a U-shaped frame 88. The U-shaped frame 88 includes two upwardly extending legs 90, 92 joined by a base 94 (FIG. 2). One leg 90 has an inwardly facing surface 96 for mounting the print head 22 thereon. The opposing leg 92 has a distal end 98 with a tab 100 extending inwardly toward the one leg 90. Preferably, the frame 88 is fixed to the receptacle 18 with screws 91. However, any method known in the art for fixing a frame to another object, such as rivets, bonding, and the like, can be used without departing from the scope of the present invention.

The fixed thermal print head 22 is mounted to the inwardly facing surface 96 of the leg, and extends into the cartridge printing area 46 when the cartridge 12 is received in the receptacle 18. The print head 22 cooperates with the ink ribbon 16 and the labeling media 14 such that the print head 22 can print characters or symbols on the labeling media. This is described in greater detail in U.S. Pat. No. 5,078,523 which is incorporated herein by reference. The labeling media 14 and ink ribbon 16 passing through the printing area 46 are advanced past the print head 22 by the platen roller 24 which maintains the ribbon 16 and labeling media 14 in close cooperation with the print head 22.

The platen roller 24 is mounted on a roller shaft 102 which is rotatably fixed to an end 108 of a pivot linkage 104. One end of the drive shaft extends through the receptacle floor 78. A drive gear 106 is fixed to the one end of the shaft 102, and is coaxial with the platen roller 24. The drive gear 106 engages a stationary gear 114 which is rotatably mounted to the underside of the receptacle floor 78. The stationary gear 114 forms part of a gear assembly 116, and meshes with the drive gear 106 to rotatably drive the platen roller 24.

The pivot linkage 104 has an opposing end 110 pivotally fixed to a pin 112 supported between the frame tab 100 and base 94 (FIG. 2). The pivot linkage pivots 104 about the pin 112 to move the platen roller 24 between a printing position (shown in FIG. 12) and a nonprinting position (shown in FIG. 11) and to engage and disengage the drive gear 106 from the stationary gear 114. A cam follower 111 extending from the pivot linkage 104 between the linkage ends 108, 110 engages a cam 118 to pivot the linkage 104 about the pin 112. Although fixing the pivot linkage 104 to the pin 112 supported between the frame tab 100 and base 94 (FIG. 2) is disclosed, other methods for movably mounting the platen roller relative to the print head, such as slidably mounting the roller shaft in a slot formed in the housing and the like, can be used without departing from the scope of the present invention.

As shown in FIG. 12, when the pivot linkage 104 pivots to move the platen roller 24 to the printing position, the drive gear 106 engages a rotatably driven stationary gear 114 to rotatably drive the platen roller 24, and the platen roller 24 extends into the receptacle 18 (FIG. 7) and urges the labeling media 14 and ink ribbon 16 against the print head 22. In the nonprinting position shown in FIG. 11, the drive gear 106 is disengaged from the stationary gear 114, and the platen roller 24 is spaced from the print head 22 to allow insertion of the labeling media 14 and ink ribbon 16 therebetween.

Referring to FIGS. 2–4, 8–13, the cam 118 engages the pivot linkage 104 to move the platen roller from the non-printing position to the printing position and to engage and disengage the drive gear 106 with the stationary gear 114. A spring 121 wrapped around one end of the pin 112 biases the linkage 104 against the cam 118 to bias the pivot linkage 104 away from the platen roller printing position. The cam 118 is fixed to a cam shaft 120 which is rotated about a cam shaft axis 113 by the lever 50 fixed to an end of the cam shaft 120 extending through the printer housing 2.

The elongated lever 50 has one end 124 fixed to the cam shaft 120, and is pivotable about the cam shaft axis 113 (shown in FIGS. 11 and 12) between a lock position (shown in FIG. 13) and an unlock position (shown in FIG. 1). Pivoting the lever 50 about the cam shaft axis 113 between the lock and unlock positions, rotates the camshaft 120 to engage and disengage the cam 118 from the pivot linkage 104. Advantageously, in the lock position, the lever opposed end 127 extends over the receptacle 18, and engages the cartridge top wall shelf 48 to lock the cartridge 12 in the receptacle 18. In the unlock position, the lever 50 is disengaged from the cartridge 12, and allows the cartridge 12 into or out of the receptacle 18. Preferably, the lever 50 includes a rib 122 extending along a lever edge to provide an engagement surface for a user to easily engage the lever 50 to pivot it about the cam shaft axis 113.

Referring back to FIGS. 7 and 8, the gear assembly 116 includes a plurality of intermeshed gears 114, 126, 128, 130, 132 rotatably mounted to the underside of the receptacle floor 78. The gear assembly 116 is rotatably driven by a motor 134 fixed to the receptacle 18. The motor 134 includes a shaft 136 which extends through the receptacle floor 78, and has a pinion 138 fixed to the shaft 136 which meshes with the gear assembly 116. The printer circuitry energizes the motor 134 to rotatably drive the shaft 136, and thus the stationary gear 114.

One of the plurality of intermeshed gears 132 is fixed to and coaxial with the ink ribbon drive shaft 62 which extends through the receptacle floor 78 to rotatably drive the ink ribbon take up spool. Advantageously, the gear assembly 116 simultaneously drives the platen roller 24 and ink ribbon drive shaft 62 to synchronize the operation of the platen roller 24 and ink ribbon take up spool to smoothly urge the ink ribbon 16 (FIG. 6) and labeling media 14 (FIG. 6) along the web path.

Referring to FIGS. 1, 4, 7, 11, and 12, once the cartridge 12 is locked in place, the platen roller 24 is in the printing position, and the drive gear 106 is engaged with the stationary gear 114, the printing machine 10 is ready to produce printed labels. When printing on the labels, the platen roller 24 and a take up spool advance the labeling media 14 and ribbon 16 through the printing area 46 past the print head 22. When a desired character is input by an operator or other means, the electronics of the machine 10 energizes pixels on the print head 22 as the labeling media 14 and ribbon 16 advance past the head 22. The head pixels are variously energized to imprint the character on the labeling media 14. This is described in greater detail in U.S. Pat. No. 5,078,523 which has been incorporated herein by reference.

After printing, labeling media 14 advances to a "cut" position, at which time, the operator manually actuates the cutting mechanism 26 to separate the labeling media 14 containing printed labels from the unused portion. As shown in FIG. 3, the cutting mechanism 26 is disposed adjacent the printing mechanism 20 at the end of the web. Labeling media 14 fed into the cutting mechanism 26 is cut by a blade (not shown) disposed within the cutting mechanism 26. The cut position exposes the printed labels to the operator through the printer housing slot 74. Once the operator actuates the cutting mechanism 26, the labels are retrieved by the operator for use.

Figure 5:
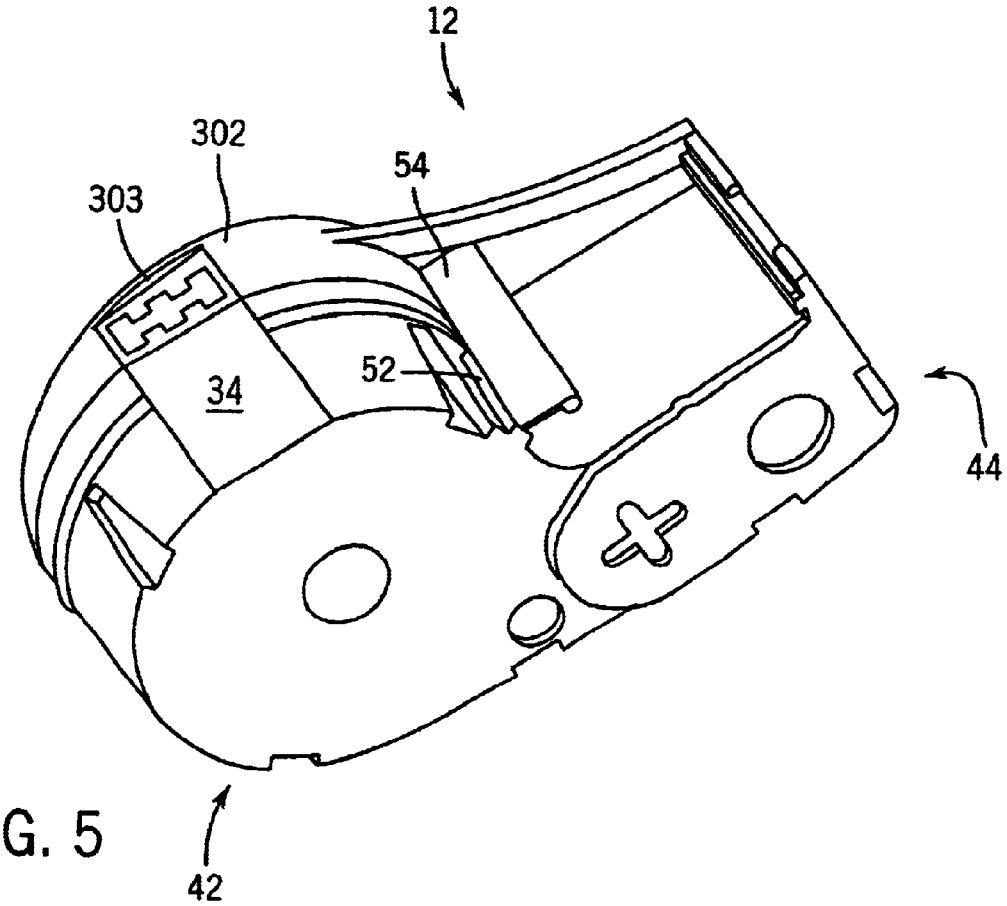
FIG. 5 is a bottom perspective view of the cartridge of FIG. 1.
Figure 14:
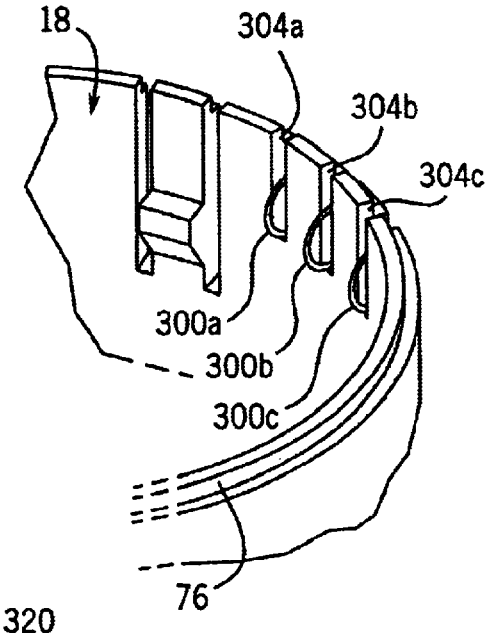
FIG. 14 is a partial illustration of the cartridge receptacle of FIG. 7 after assembly.

Referring now to FIGS. 1, 3, 5, and 14, in operation the printer 10 identifies the cartridge 12 by means of the electrical connection of the spring contacts 300A, 300B, and 300C (FIGS. 3 and 14) with the conductive strip 302 (FIG. 5). Referring now specifically to FIGS. 3 and 14, the three spring contacts 300A, 300B, and 300C are physic ally connected to an end of the circuit board 72. When assembled in the printer 10, the spring contacts 300A, 300B, and 300C extend through slots 304A, 304B, and 304C defined in the sidewall 76 of the cartridge receptacle 18, respectively. The spring contacts 300A, 300B, and 300C therefore extend axially into the cartridge receptacle 18, and are located in the cartridge receptacle 18 such that they provide an electrical connection to the conductive strip 302 (FIG. 5) coupled to the cartridge sidewall 34 (FIG. 5) when the cartridge 12 is inserted into the cartridge receptacle 18.

Figure 7:
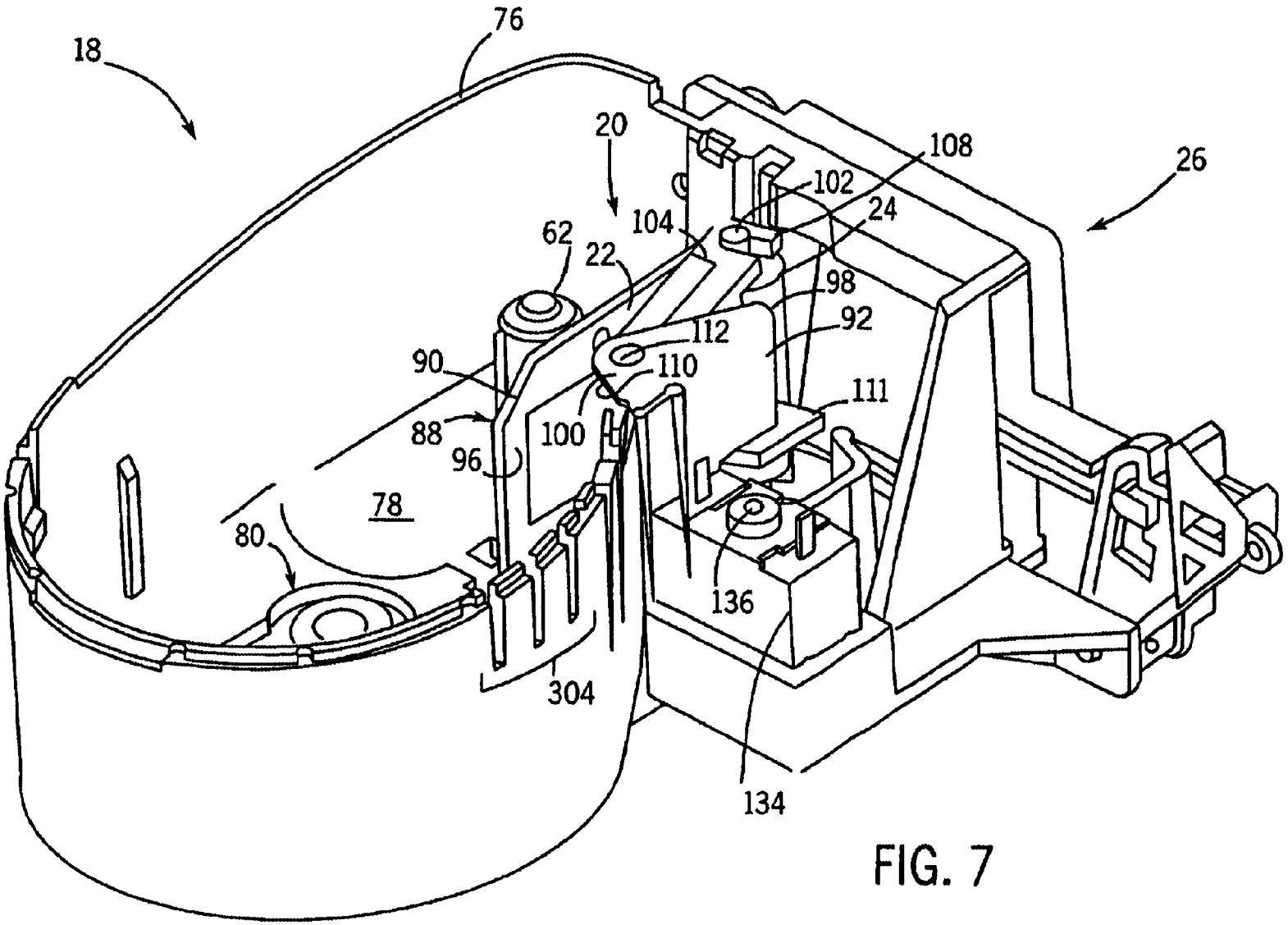
FIG. 7 is a top perspective view of the cartridge receptacle of the printer of FIG. 2.
Figure 8:
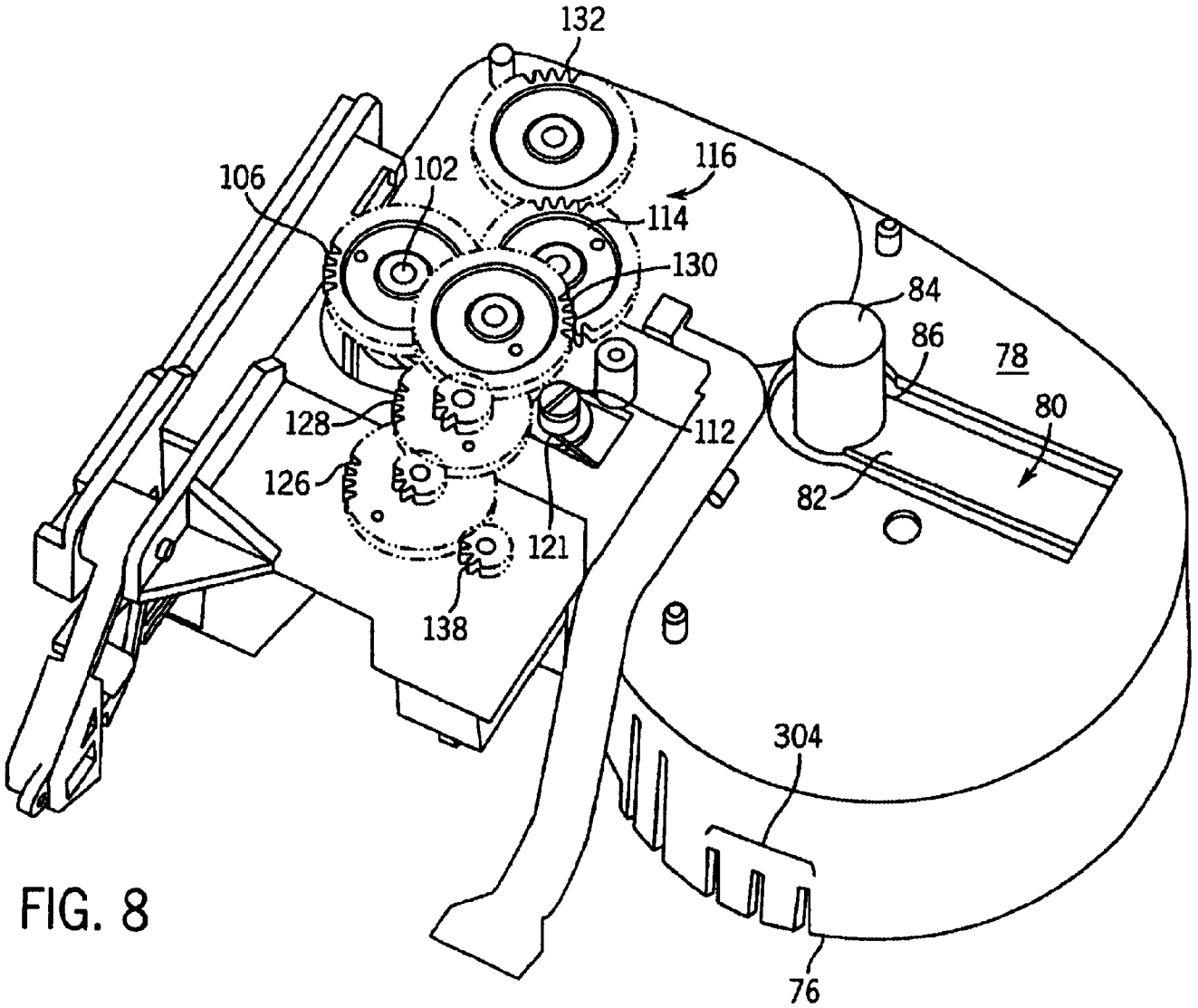
FIG. 8 is a bottom perspective view of the cartridge receptacle of FIG. 7.
Figure 9:
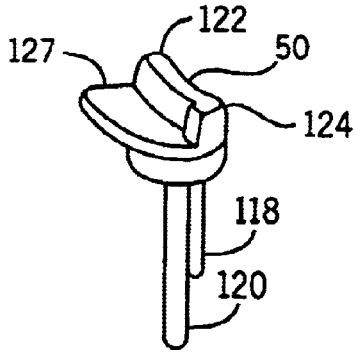
FIG. 9 is a perspective view of the camshaft, cam and lever of FIG. 3.
Figure 10:
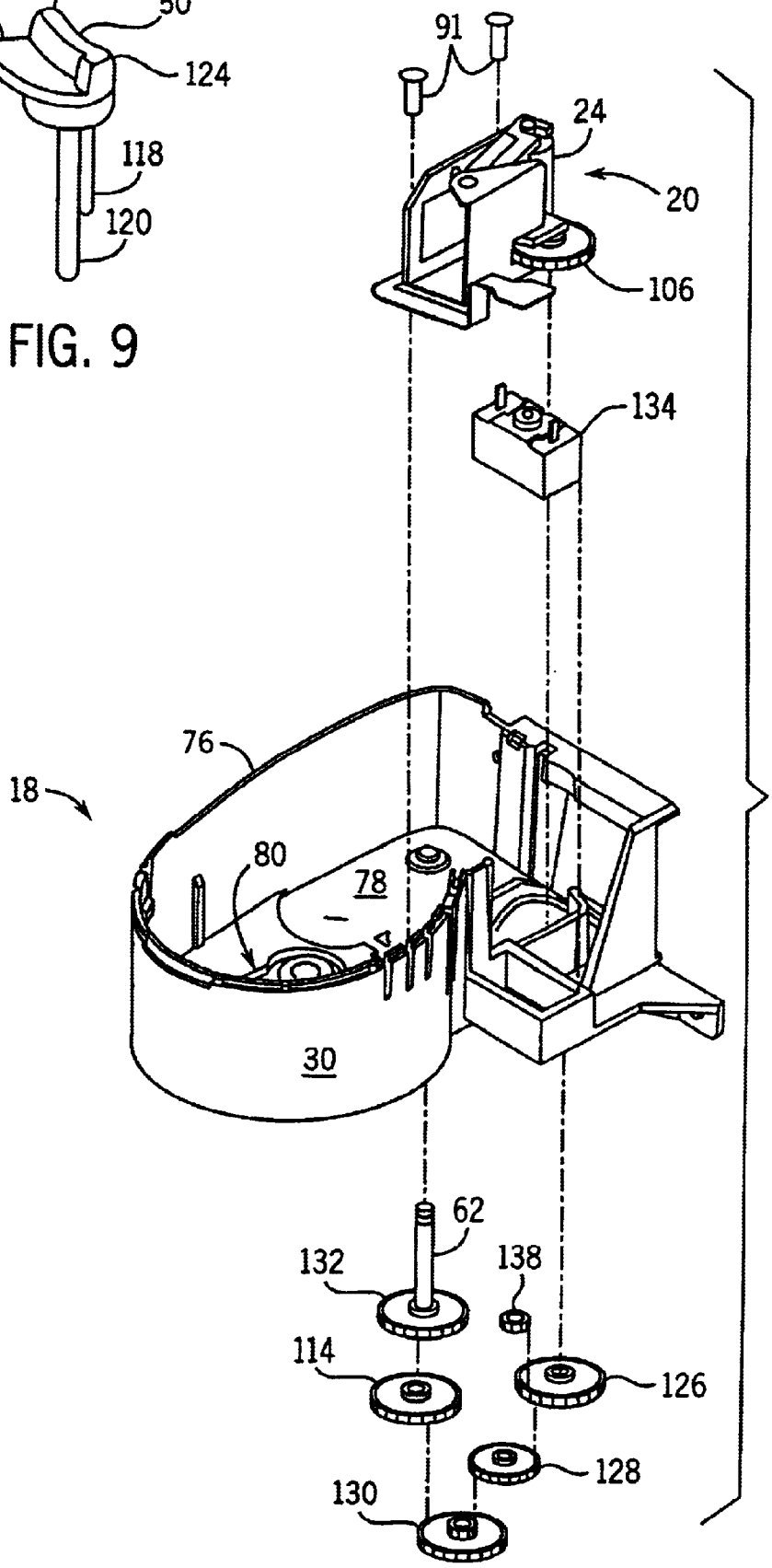
FIG. 10 is an exploded perspective view of the cartridge receptacle and cutter mechanism of FIG. 3.
Figure 13:
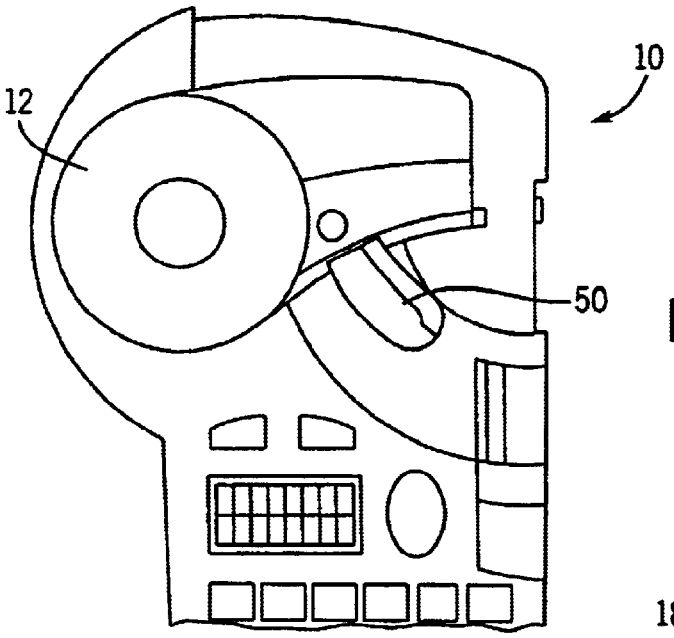
FIG. 13 is a front view of the printer of FIG. 1 with the lever in the lock position.
Figure 15:
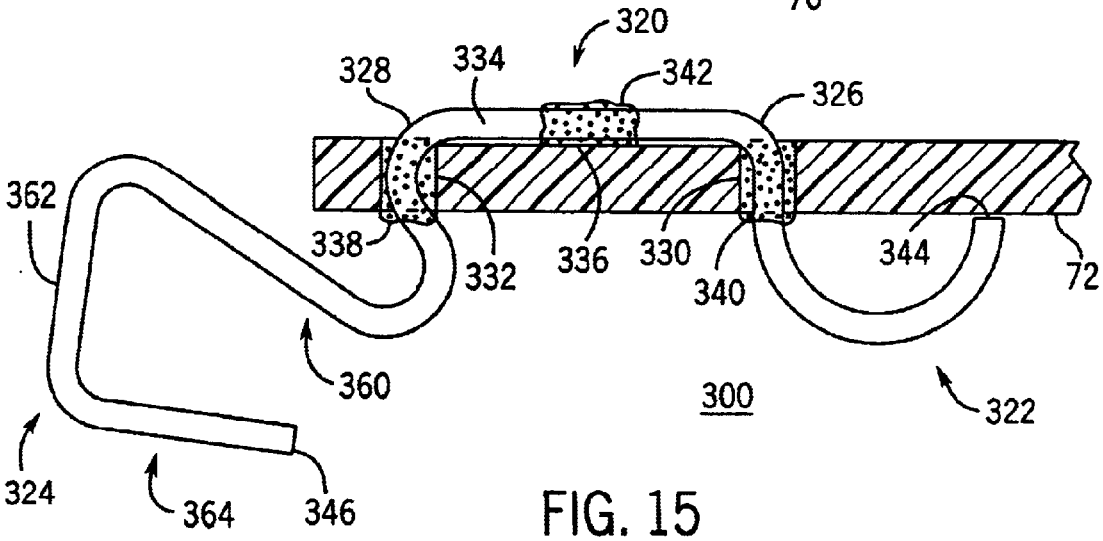
FIG. 15 is a side illustration view of a spring contact of FIG. 3 as assembled in the printed circuit board of FIG. 3.

Referring now to FIG. 15, each of the spring contacts 300 comprises a spring wire which is bent into three sections: a generally U-shaped mounting section 320, a semi-circular portion 322, and a contact portion 324. Each of the legs 326 and 328 of the generally U-shaped mounting section 320 is directed through a through-hole 330 and 332 respectively of the printed circuit board 72, while the flat section 334 of the generally U-shaped mounting section 320 rests in a slot 336 defined in the printed circuit board 72 between the through-holes 330 and 332. Solder joints 338, 340 and 342 retain the spring contact 300 in the mounting-holes 330 and 332 and associated slot 336, provide an electrical connection between the spring contact 300 and the circuitry on the printed circuit board 72, and provide structural stability as the contact end is elastically deformed when a cartridge 12 (FIG. 4) is inserted in the cartridge receptacle 18 (FIG. 7). The multiple solder joints 338, 340, and 342 help to distribute force applied along the spring contact 300 through interaction with the conductive strip 302, and further provide a redundant failure mechanism, wherein an electrical connection between the spring contact 300 and the printed circuit board 72 continues to be maintained even if one or more of the solder joints 338, 340, and 342 is broken.

The semi-circular portion 322 of the spring contact 300 extends downwardly from the bottom of the printed circuit board 72 and rearwardly to a point on the circuit board 72 substantially equivalent to the diameter of the semi-circular portion 322 from the through-hole 332. The semi-circular section 322 provides structural stability to the spring contact, and does not provide an electrical connection. Therefore, the end 344 of the semi-circular portion 322 is not connected to the board.

The contact portion 324 extends outwardly from the edge of the printed circuit board 72 such that the contact portion 324 can be inserted through the slots 304A, 304B and 304C (all in FIG. 14) described above. The second end 346 of the spring contact 300 hangs loose allowing the contact portion 324 to elastically deform and expand as a force is applied i.e., as a cartridge 12 (FIG. 4) is inserted in the cartridge receptacle 18 (FIG. 7). The contact section 324 is also generally U-shaped and comprises three sections 360, 362, 364: an upwardly extending section 360, a generally downwardly extending section 362, and a rearwardly extending section 364. The upwardly extending section 360 is angled and includes a bend, such that the contact section 364 can pivot about this section as a force is applied. Electrical contact between the spring contact 300 and the printed circuit board is generally made to the downwardly extending section 364, which provides a relatively large and flexible contact surface.

Each of the spring contacts 300 is constructed of a music wire generally used in the construction of springs, and is preferably coated with a highly conductive layer. In the embodiment disclosed herein, the spring contacts 300 are constructed of a music wire having a diameter of 0.014 inches which is coated with an electrolytic nickel having a depth between two ten thousandths and three ten thousandths of an inch. Music wire is typically constructed of a high carbon steel wire having a high degree of elasticity, and is frequently used in the construction of small springs.

Referring to FIGS. 3–7, as noted above, when the cartridge 12 is inserted into the cartridge receptacle 18, the conductive strip 302 is aligned with the spring contact 300. The insertion of the cartridge 12 applies a force against the spring contacts 300, causing the spring contacts 300 to provide a responsive spring force against the conductive strip 302, and to contact the conductive strip 302 with a wiping motion, ensuring a good electrical connection between the conductive strip 302 and the spring contacts 300. The ability to extend into the cartridge receptacle and contract as the cartridge is inserted is particularly important where, as shown above, the cartridge receptacle and cartridge include circular or circular elements as opposed to flat surfaces. Because the spring contacts can elastically expand and contract and provide a spring force against the conductive strip 302, the electrical connection is not affected by minor variations in the size and diameter of the cartridge 12, or in slight misalignments of the cartridge 12 in the cartridge receptacle 18.

Figure 16:
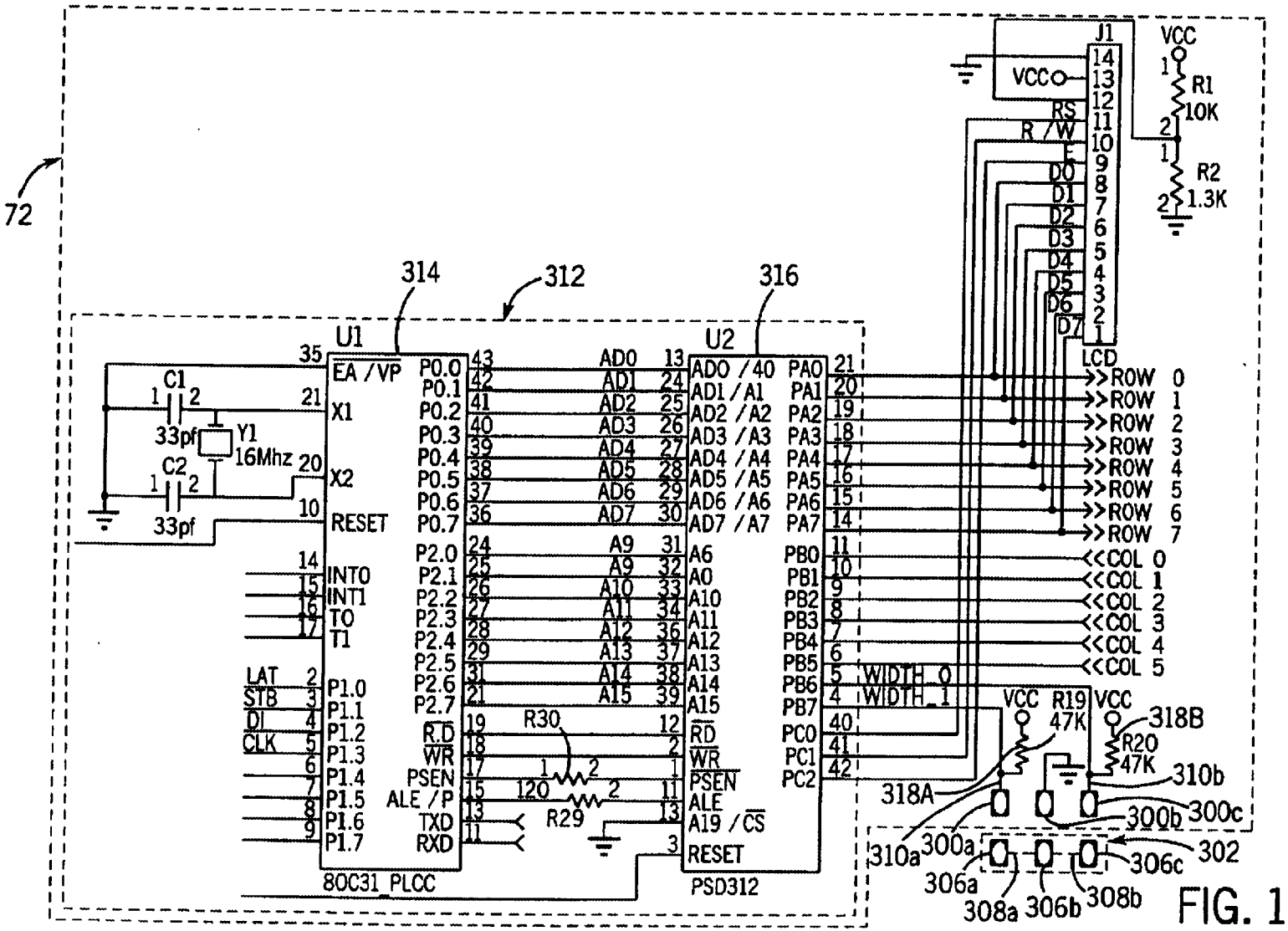
FIG. 16 is a partial circuit diagram of the printed circuit board of FIG. 3, illustrating the cartridge identification circuit constructed in accordance with the present invention.

Referring now to FIG. 16, the spring contacts 300A and 300C are coupled to a processing unit 312 which is electrically coupled to at least two of the spring contacts 300A and 300C by means of the input lines 310A and 310B respectively.

Within the processing unit 312, the input lines 310A and 310B are coupled to a peripheral interface device 316 which in turn directs signals received from the input lines 310A and 310B to a microprocessor 314. The microprocessor 314 is programmed to determine the width of a labeling media 14 (FIG. 6) contained in a cartridge 12 (FIG. 6) inserted in the printer device 10 (FIG. 1) depending on whether the signals received on the input lines 310A and 310B are at reference potential or at a circuit common.

Referring now to FIGS. 16 and 17, it can be seen that each of the spring contacts 300A and 300C are tied to a reference potential through a resistor 318 A and 318B, respectively. The third spring contact 300B is tied directly to circuit common. Therefore, each of the input lines 310A and 310B are normally held at the reference potential, and are pulled low to circuit common only when one of the spring contacts 300A and 300C is connected to the spring contact 300B.

Referring now to FIGS. 5, 16 and 18–20, the conductive strip 302 which is coupled to the cartridge 12 provides three conductive contact pads 306A, 306B and 306C which are physically aligned with the spring contacts 300A, 300B and 300C in the cartridge receptacle 18 (FIG. 7) thereby providing an electrical connection between the conductive contact pad 306A, 306B, 306C, and the spring contacts 300A, 300B, and 300C, respectively. The conductive strip 302 further comprises traces 308A and 308B, which selectively tie the contacts 306A and 306C to the contact 306B. The traces 308A and 308B selectively pull the input lines 310A and 310B to a circuit common, thereby providing input data to the microprocessor 314, which is programmed to determine a width of the labeling media 14 (FIG. 6) in the inserted cartridge 12 (FIG. 6) based on this data, as described more fully below.

Referring now specifically to FIGS. 16–20 and to Table 1, below, three possible configurations of the conductive strip 302 are shown. Referring first to FIG. 18, in a first configuration, hereafter referred to as conductive strip 302A, the contact 306A is tied to the contact 306B through the trace 308A. When the conductive strip 302A is electrically coupled to the contacts 300A, 300B, and 300C, the spring contact 300A is tied to contact 300B through the contact 306A, the trace 308A and the contact 306B. Microprocessor 314 senses that the input line 310A has been pulled to circuit common while the input line remains 310B at reference potential. The microprocessor 314 determines a width of a tape or other labeling media 14 (FIG. 6) based on this input data, as shown in row 1 of Table 1. In a second configuration of conductive strip 302B shown in FIG. 19, the trace 308B electrically couples the contact 306C to the contact 306B. In a similar manner as described above and as shown in row 2 of Table 1, the input line 310B is pulled to circuit common while the input line 310A remains at reference potential. In the conductive strip 302C of FIG. 20 both of the input lines 310A and 310B are pulled to circuit common as shown in row 3 of Table 1, below. If a cartridge 12 (FIG. 6)is not inserted in the cartridge receptacle 18 (FIG. 7), both of the input lines 310A and 310B are at reference potential, as shown in row 4 of Table 1.

TABLE 1

| | 310A | 310B | What does it tell the Printer? |
|---|---|---|---|
| 302A | 0 | 1 | Tape media width #1 |
| 302B | 1 | 0 | Tape media width #2 |
| 302C | 0 | 0 | Tape media width #3 |
| No Connection | 1 | 1 | Cartridge is not inserted |

Table 1 - Characteristics identified with three contacts and three cartridge PCB's.

While there has been shown and described what are at present considered the preferred embodiment of the invention, it will be obvious to those skilled in the art that various changes and modifications can be made therein without departing from the scope of the invention defined by the appended claims. For example, although a microprocessor and associated peripheral interface device have been shown, it will be apparent that a number of available types of processing units could be used, including microprocessors, microcontrollers, and other logical operators. These devices can be used in conjunction with a peripheral device, as shown above, or through a direct connection to the contacts. Furthermore, although a specific spring contact construction has been shown, it will be apparent that modifications can be made thereto while still providing the required functionality. For example, the number of contacts and associated logical operations can be varied depending on the number and type of labeling media characteristics to be determined. Also, although the conductive strip 302 is shown adhesively coupled to the cartridge 12, other methods of coupling the conductive strip 302 to the cartridge will be apparent to those of ordinary skill in the art. Furthermore, although a printed circuit board comprising electrical conductive pads and associated pads has been shown, it will be apparent that conductors of various types and varieties can be used to electrically couple the spring contacts together, including, for example, conductive or metallized tape that does not include defined pads and connecting traces.

We claim:

1. A cartridge-based printing system comprising:

a printer including:

a housing;

a printed circuit board coupled to the housing, the printed circuit board including a processing unit;

a cartridge receptacle coupled to the housing, the cartridge receptacle including a sidewall including a plurality of slots;

a cartridge containing a labeling media positioned in the receptacle;

a plurality of spring electrical contacts electrically coupled to the printed circuit board and extending into the cartridge receptacle from the slots of the sidewall;

said cartridge comprising a cartridge housing including a plurality of walls defining a semi-circular labeling media container;

a conductive material coupled to one of the plurality of walls, the conductive material comprising a plurality of conductive electrical contacts being positioned on the cartridge to align with and to provide an electrical connection to the plurality of spring electrical contacts in the printer, and the plurality of conductive electrical contacts being configured to provide an identification of the cartridge;

wherein insertion of the cartridge into the cartridge receptacle of the printer causes at least some of the spring electrical contacts to contact the conductive material thereby producing an electrical logic signal which is processed by the processing unit to identify a characteristic of the cartridge.

2. The cartridge-base printing system as defined in claim 1, wherein insertion of the cartridge into the cartridge receptacle causes the spring contacts to contract, such that a spring force is exerted by the spring contact toward the cartridge.

3. The cartridge-based printing system as defined in claim 1, wherein the conductive material forms part of a printed circuit board coupled to the cartridge.

4. The cartridge-based printing system as defined in claim 1, wherein the conductive material selectively electrically connects at least one of the spring contacts to another of the spring contacts.

5. The cartridge-based printing system as defined in claim 1, wherein the spring contacts are comprised of a spring wire coated with a conductive layer.

6. The cartridge-based printing system as defined in claim 1, wherein said plurality of slots are formed in an arcuate section of the cartridge receptacle.

7. A method for identifying a cartridge inserted in a cartridge-based printer, the method comprising:

forming a plurality of elastically deformable spring contacts from a selected length of spring wire;

soldering the spring contacts to a printed circuit board including a processing unit;

installing the printed circuit board in the printer such that the spring contacts extend axially into a cartridge receptacle from a slot in a sidewall of the cartridge receptacle;

coupling a conductive material including a plurality of contacts for identifying a characteristic of a labeling media in the cartridge to a wall of the cartridge, the conductive material being positioned to provide an electrical connection to the spring contacts when the cartridge is inserted in the cartridge receptacle;

inserting the cartridge into the cartridge receptacle;

reading an electrical logic signal from at least one of the spring contacts;

determining the characteristic of the labeling media in the cartridge based on the electrical logic signal.

8. The method as defined in claim 7, wherein at least one of the spring contacts provide a spring force against the conductive material of the inserted cartridge, thereby maintaining a good electrical connection between the printed circuit board in the printer and the conductive material on the cartridge.

9. The method as defined in claim 7, further comprising inserting the spring contacts in the printed circuit board through a plurality of through-holes and soldering the spring contacts to the circuit board in a plurality of locations.

10. The method as defined in claim 9, further comprising forming a slot between at least a first and a second through-hole in the printed circuit board, and soldering the spring contact to the slot and to each of the through-holes.

* * * * *

UNITED STATES PATENT AND TRADEMARK OFFICE

CERTIFICATE OF CORRECTION

PATENT NO. : 6,644,876 B2 
DATED : November 11, 2003
INVENTOR(S) : Richard L. Carriere et al.

It is certified that error appears in the above-identified patent and that said Letters Patent is hereby corrected as shown below:

Column 8,
Line 21, “physic ally” should be -- physically --.

Column 11,
Line 48, “cartridge-base” should read -- cartridge-based --.

Signed and Sealed this

Thirtieth Day of March, 2004

JON W. DUDAS
*Acting Director of the United States Patent and Trademark Office*